United States Patent [19]

Karra

[11] 4,384,684

[45] May 24, 1983

[54] APPARATUS AND METHOD FOR AUTOGENOUS GRINDING BY COUNTERCURRENT FLOW OF TWO MATERIAL STREAMS

[75] Inventor: Vijia K. Karra, Greendale, Wis.

[73] Assignee: Rexnord Inc., Milwaukee, Wis.

[21] Appl. No.: 200,727

[22] Filed: Oct. 27, 1980

[51] Int. Cl.[3] ..... B02C 17/18

[52] U.S. Cl. ..... 241/26; 241/171; 241/284

[58] Field of Search ..... 241/20, 26, 38, 170, 241/171, 181, 182, 183, 228, 284; 198/821

[56] References Cited

U.S. PATENT DOCUMENTS

| | | | |
|---|---|---|---|
| 2,456,266 | 12/1948 | Gates | 241/183 X |
| 2,698,144 | 12/1954 | Reiffen | 241/228 X |
| 2,998,201 | 8/1961 | Ratkowski | 241/183 |
| 3,204,878 | 9/1965 | Peacock | 241/228 X |

FOREIGN PATENT DOCUMENTS

| | | | |
|---|---|---|---|
| 574622 | 4/1933 | Fed. Rep. of Germany | 241/183 |
| 1081588 | 12/1954 | France | 198/821 |
| 1104437 | 2/1968 | United Kingdom | 198/821 |
| 1381042 | 1/1975 | United Kingdom | 198/821 |

*Primary Examiner*—Howard N. Goldberg
*Assistant Examiner*—Fred A. Silverberg
*Attorney, Agent, or Firm*—John M. Neary; Vance A. Smith

[57] ABSTRACT

An apparatus for the grinding of hard materials having a conveyor for forming a thin layer of material and moving the layer upward at an angle, and then causing the material in the upper region of the conveyor to tumble back down and along the surface of the upward moving layer, to generate a fine abraded product from the rubbing surfaces of the material.

29 Claims, 6 Drawing Figures

APPARATUS AND METHOD FOR AUTOGENOUS GRINDING BY COUNTERCURRENT FLOW OF TWO MATERIAL STREAMS

BACKGROUND OF THE INVENTION

This invention relates to devices for the grinding of hard materials and more particularly to the abrasion of materials primiarly due to the relative movement between particles.

For many years, the techniques for grinding materials has remained relatively constant. Typically, grinding of materials is done through tumbling action which takes place in long rotation cylinders in which the material is fed. As the cylinders rotate, material is circulated upward and then as gravity overcomes the angle of repose, the material begins to tumble back downward into the material which is being rotated upward.

Although such mills are well known to be inefficient and have high power consumption, industry continues to use them for various reasons, among the major of which is that no viable alternative is available. Once erected in the field, flexibility of operation of the prior art grinding mills is limited, such as, for example, the ability to vary speeds. As energy consumption and efficiency in operation have become increasingly more important, it is now readily apparent that yesterday's grinding mill is no longer satisfactory for today's needs. It is, therefore, a paramount object of the present invention to provide an apparatus which will effectively grind hard material without the comensurate disadvantageous high energy requirements of prior art grinding mills.

SUMMARY OF THE INVENTION

To attain the object set forth above and other objects that will be apparent from a reading of this description, an apparatus for grinding of materials is provided which includes a means for feeding the material to be ground into a feed section located at one end of the apparatus, a means for removing the material as a layer from the feed section, means for elevating the layer, and finally a means for causing the material to tumble down over the upward moving layer to cause abrasion to occur between particles moving relative to one another.

For a more complete understanding of the present invention, reference is now made to the detailed description and appended drawings in which.

DESCRIPTION OF THE PREFERRED EMBODIMENT

Figure 1:
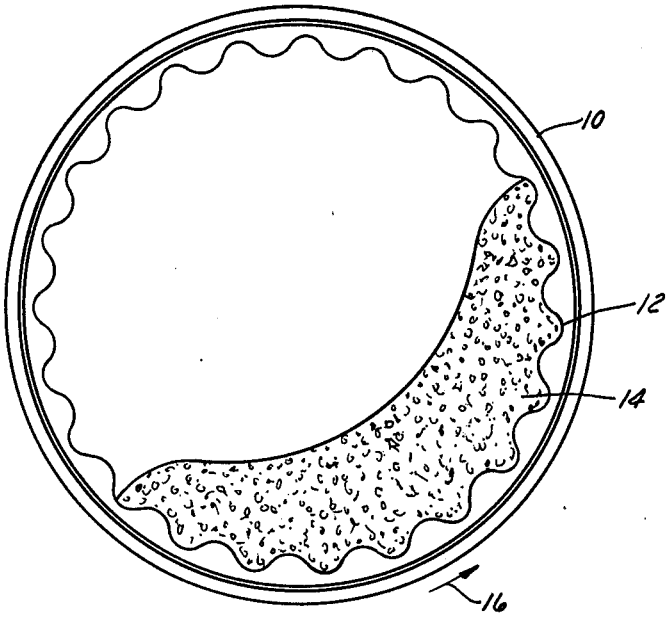
FIG. 1 PRIOR ART
FIG. 1 is a schematic view in side section of a typical grinding mill of the prior art.

FIG. 1 schematically depicts in side section a shell 10 of a typical prior art grinding mill. Shell 10 is provided along its interior surface with a plurality of axially aligned channels 12 which assist in moving and lifting material 14 as shell 10 rotates in a direction 16. When material 14 reaches a particular point along its arcuate path, the force of gravity overcomes any centrifugal force imparted to the material causing the material to cascade back upon itself. Care is exercised that the rotational speed of shell 10 does not exceed the speed at which centrifugal forces equal or exceed gravitational forces since clearly it is desired to have the material impact and abrade. Generally, most tumbling mills operate at 60 to 90% of this critical speed.

There are various mechanisms at work in any grinding mill which contribute to the reduction in particle size. When a large particle is hurled against another particle, the reduction in size is caused by impact. When a smaller particle is nipped between two larger particles, resultant reduction is called attrition. Finally, the rubbing of particles against one another is termed grinding by abrasion. All play a role to one degree or another in grinding mill operations.

To an extent, one type of grinding can be maximized, generally at the expense of the other two. For example, use of a slurry suspending intermediate size particles presents the particles for continuous nipping between larger particles. Obviously, the presence of the liquid minimizes the effect of impact and the lubricity of the liquid is deleterious to the rubbing contact for purposes of abrasion.

In grinding mills, particularly of the autogeneous type, the dominant grinding mechanism is abrasion. Attrition by impact, however, is present and its effect becomes greater as the rotational velocity of the mill is increased. Additionally, impact grinding increases with increase in mill diameter. However, it is generally preferred to operate a mill such that abrasion is emphasized by rotating the mill at the lower end of the 60 to 90% critical speed range. In part, attrition by abrasion is favored by the relative velocity differential between particles. That is, the abrasion rate increases if the general direction of the cascade of particles is along the surface of the particles being moved upward by the rotating mill. Higher speeds of rotation tend to keep the particles against the drum wall longer, so that when they fall they follow a longer free-fall trajectory across the interior of the drum toward the "toe" or lower end of the bed of particles, favoring impact rather than abrasive grinding.

The relative movement of particles referred to above occurs only in the top portion of the material bed. Below this portion or "active" region where abrasion through interparticle rubbing results is a "passive" region in which very little relative motion exists.

Figure 2:
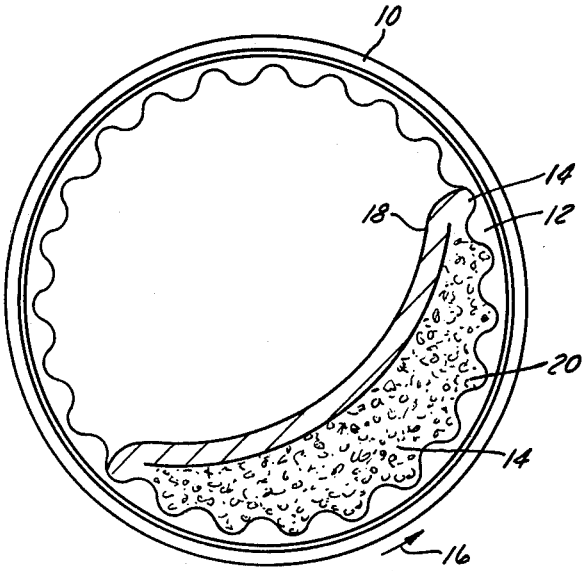
FIG. 2 PRIOR ART
FIG. 2 is a view similar to that of FIG. 1 with a pictorial representation of the active zone where abrasion occurs.

The active and passive regions may be seen in the prior art representation of FIG. 2 in regions 18 and 20, respectively. A particle which is moved along within region 20 observes little relative motion until it reaches a point where the angle of repose of the material and the small centrifugal force is exceeded by the force of gravity. The particle then tumbles down within region 18 which contains both the tumbling particles and the surface of the upward moving material. It is in region 18 in which maximum abrasion occurs.

As stated before, grinding by rotating mills takes place only in a small volume of the material at any one instant of time. Most of the material volume is inactive and contributes greatly to the energy requirements for rotating the mill and its contents.

Figure 3:
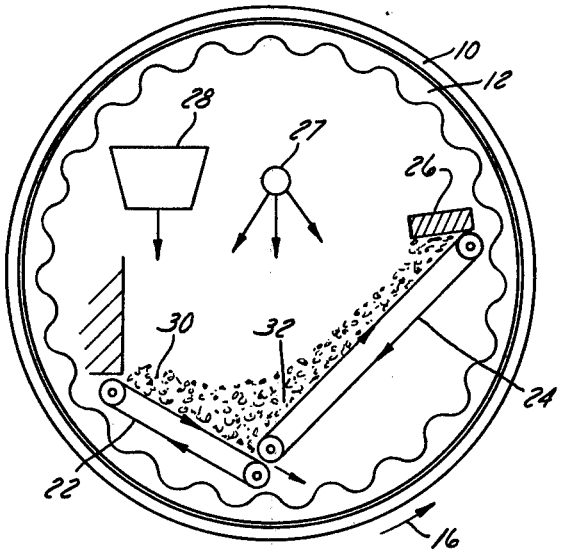
FIG. 3 is a schematic representation of an embodiment of the present invention which for the sake of clarity of description is shown circumscribed by the shell of a grinding mill.

A preferred embodiment of the present invention may be seen in the schematic of FIG. 3. As may be seen, the apparatus is placed inside of a mill shell in order to invoke comparisons with FIGS. 1 and 2. The purpose of FIG. 3 is to graphically point out the alteration in the traditional modus operandi which can be accomplished by an apparatus made in accordance with the present invention. That is, by the careful positioning of devices for moving material such as conveyors, one can abrade material without creation of an unproductive mass of relatively stationary particles positioned below an active zone.

The apparatus may consist of a plurality of conveyors such as conveyors 22 and 24. Conveyor 24 is inclined upward from the horizontal toward a stop 26. Positioned above conveyor 22 may be any desired material feeding means such as hopper 28. A means 27 for spraying the material with water is positioned above conveyor 24.

Conveyor 22 moves the material from a feed zone 30 to a collection zone 32, thence onto the conveyor 24. The material moves as a layer up to the stop where it is caused to tumble countercurrent down upon itself. The term "countercurrent" as used herein refers to a nonlinear or turbulant motion of the upper, downwardly moving layer over the lower, upwardly moving layer, involving continuous intermixing of the two layers. The predetermined inclination of the conveyor 24 is primarily a function of the angle of repose of the material. A continuous water spray reduces the amount of dust and washes the abraded particles out of the system either through aperatures in conveyor belt 24 or through any desired sluice arrangement.

Figure 4:
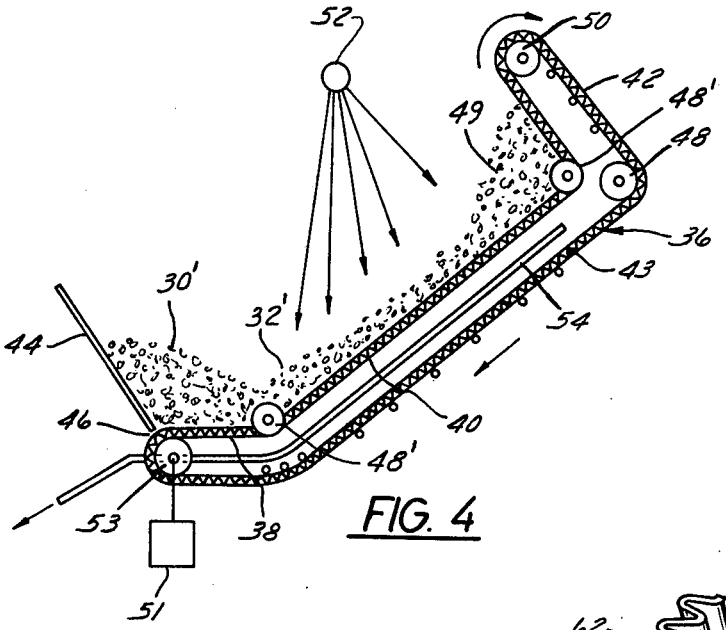
FIG. 4 is a schematic of still another embodiment of the present invention.

FIG. 4 depicts a modified embodiment in which a single conveying element is employed. As shown the endless conveyor belt 36 is made into three sections 38, 40, 42. The conveyor belt may be provided with material restraining means such as lifters 43 or the lifters 58 on the belt shown in FIG. 6, to facilitate carrying of the material. Material is fed onto the feed zone 30′ of the feed section 38 of the conveyor, which also contains a sluice gate 44 positioned above section 38 with a predetermined gap 46. An inclined section 40 carries the material in layer form and provides a base on which the tumbling material can interact with the layer. The section 42, which moves about idlers 48′ and around sprockets 48 and 50, causes the material to tumble downwardly from an upper zone 49 over the upwardly moving layer to a collection zone 32′. An appropriate power source 51 may be employed, as desired, which drives one of the sprockets, such as sprocket 53.

Figure 5:
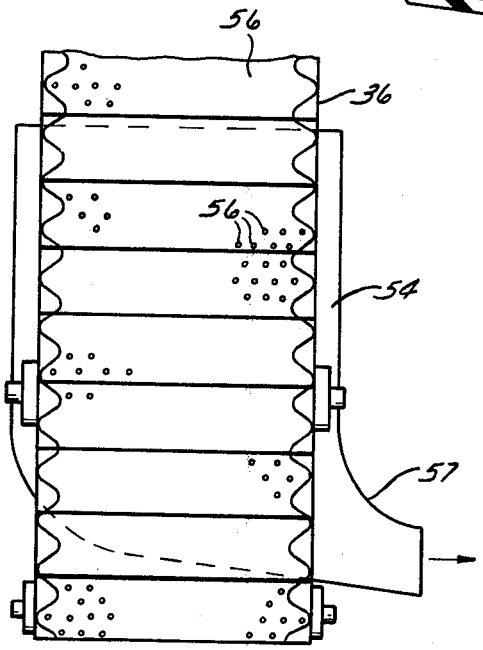
FIG. 5 depicts in plan view the conveyor belt with underlying channel for collecting fluids and abraded material.

Positioned above section 40 is a nozzle or a set of nozzles 52 attached to an appropriate supply of fluid, such as water for spraying water onto the material. Beneath sections 38 and 40 is a collecting channel 54 for collecting water and abraded particles which are removed from the material through apertures in belt 36. FIG. 5 shows a plan view of a portion of belt 36 with apertures 56 and underlying channel 54 with its discharge spout 57.

The size of the apertures 56 and the gap 46 is predetermined to permit only the particles smaller than the predetermined size to egress through the apertures, and the larger particles are retained for recycling into the active grinding zone.

Figure 6:
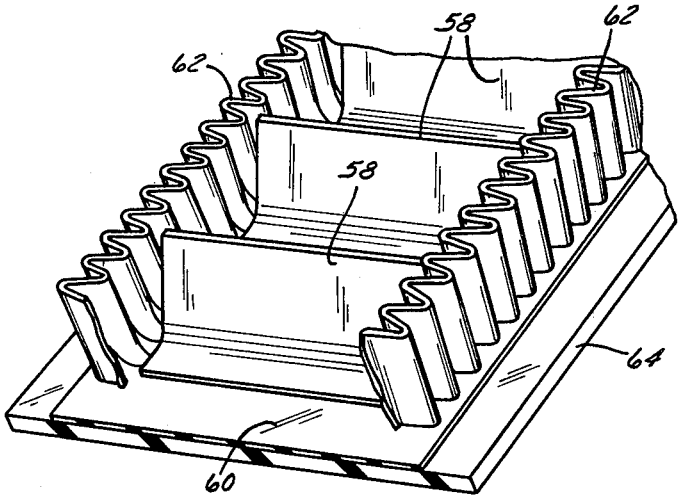
FIG. 6 shows a perspective view of a conveyor belt which may be used with the present invention.

Various types of endless conveyors may be employed depending upon the results desired. For example, FIG. 6 depicts a flexible belt conveyor which has a plurality of vertical lifters 58 spaced predetermined distances apart along a flexible base 60. Accordian type walls 62 form flexible sides for base 60. An extension 64 of base 60 beyond walls 62 provides a surface against which idlers 48′ ride. A belt such as that described may be modified from one purchased from Flexowall Corporation. Other types of carriers such as metallic mest belts may be used depending upon the material being processed.

Although the apparatus is primarily designed for the autogeneous grinding of materials, supplementary elements such as spherical steel parts may be added as desired to facilitate impact and attritional grinding. Additionally depending again on the type of material being ground, the incline of the intermediate zone may be varied. Structural variations in the dimensions of conveyor side walls and lifters may also be desired.

An important aspect is to preferentially ensure that the thickness of the layer of material being carried upward be of approximately the same magnitude as the "feed size" of the material. "Feed size" may be defined as the sieve size corresponding to that at which 80% of the feed materials passes. When the layer exceeds the feed size by a predetermined amount, i.e. about 2 to 3 times the feed size, a small passive zone may be created at the bottom of the layer leading to a reduction in the operation efficiency. Thus, the thickness of a layer depends to a great extent on the feed size of the material to be processed.

The speed at which the material is moved upward is not normally a critical variable although it has been determined that a range of about 60–80% of the critical speed of an equivalent diameter tumbling mill is desirable. Lesser speeds produce relative speeds between particles which may not be satisfactory. Greater speeds may emphasize impact and sacrificing abrasion since the pattern of material cascading downward may be altered.

The following claims should be interpreted with the foregoing descriptive matter in mind. It is intended that modifications and equivalents that will be apparent to one skilled in the grinding art after a reading of the description be included within the spirit of the claims.

I claim:

1. Apparatus for the grinding of materials comprising:
(a) means for feeding the material into one end of said apparatus;
(b) means for forming said material as a layer and moving the layer in an upward direction at a substantially constant angle to the horizontal less than its angle of repose; and
(c) means positioned at an upper end of said moving means for reversing the direction of the material and causing said material to tumble downward along the surface of said upward moving layer thereby resulting attrition by abrasion.

2. The apparatus of claim 1 in which said moving means is an endless conveyor.

3. Apparatus for the grinding of materials, comprising:
(a) means for feeding the material into one end of said apparatus;
(b) means for forming said material as a layer;

(c) an endless conveyor for moving the layer in an upward direction at an angle less than its angle of repose; and (d) means positioned at an upper end of said conveyor for reversing the direction of the material and causing said material to tumble downward along the surface of said upward moving layer thereby resulting in attrition by abrasion.

4. The apparatus of claim 3 including means for separating particles of less than a predetermined size from the remainder of the material.

5. The apparatus of claim 4 in which said separating means include means for spraying a liquid over the tumbling material.

6. The apparatus of claim 5 in which said separating means further includes perforations in the endless conveyor through which the liquid and said particles egresses.

7. The apparatus of claim 6 including a channel positioned beneath the endless belt for collecting the liquid egressing through the perforations.

8. The apparatus of claim 5 in which said separating means includes a sluice gate spaced a predetermined distance above the lower end of said endless conveyor for permitting the liquid to egress from said apparatus.

9. The apparatus of claim 3 in which a multiplicity of grinding elements having an abrasion resistance higher than the abrasion resistance of said material are present in the material.

10. The apparatus of claim 3 in which said endless conveyor has a plurality of spaced lifters.

11. The apparatus of claim 3 in which opposing flexible side walls are secured to the endless conveyor.

12. Apparatus for the autogenous grinding of materials comprising:

(a) an endless conveyor for moving a layer of material in an upwardly inclined direction from a lower zone to an upper zone;

(b) a material feeder for feeding material to be ground to said conveyor at a controlled rate;

(c) means positioned at the upper end of said conveyor for reversing the direction of the material and causing the material to tumble downward along the surface of said upward moving layer toward said lower zone; and (d) means for removing from said conveyor particles of the material below a predetermined size.

13. The apparatus of claim 12 in which said endless conveyor has flexible side walls to contain the material.

14. Apparatus for the grinding of materials comprising:

(a) a first conveyor means for moving material from a feeding zone to a collection zone;

(b) a second conveyor means, including an endless conveyor having flexible side walls to contain the material, for moving the material in a layer in an upward direction away from the collection zone; and (c) blocking means positioned at the upper end of said second conveyor means for reversing the direction of the material and causing the material to tumble downward along the surface of said upward moving layer and into the collection zone.

15. The apparatus of claim 14 having a means for spraying water positioned adjacent said endless conveyor, said endless conveyor being perforated to permit egress of water carrying particles of a size smaller than the perforations.

16. The apparatus defined in claim 14, wherein said first and second conveyor means include separate sections of a single flexible conveyor belt.

17. A method of grinding materials including the steps of:

(a) collecting the material to be ground in a feed region;

(b) moving the material from the feed region as a layer in an upward direction at a generally constant angle to the horizontal; and (c) reversing the motion of the material so that it passes countercurrent downward over the surface of the upward moving layer back into the feed region.

18. The method of claim 17 including the step of separating particles of a predetermined size.

19. The method of claim 18 including the step of blending the material moving down the surface of the upward moving layer with the material in the feed zone.

20. The method of claim 19 in which the particles having a predetermined size or less are removed by spraying the material with a liquid causing the particles to pass through filtering material beneath the layer.

21. A method of high efficiency autogenous grinding of material, comprising:

forming the material in a layer having a thickness of about one to three times the feed size of the material on an inclined endless conveyor by driving said conveyor under the material in a collection zone and allowing the material to distribute itself as a layer on the conveyor; moving the material on said conveyor form the collection zone in an upwardly sloping direction at an angle less than its angle of repose; reversing the direction of the material near the top of its upward travel and cascading the material from the top of its upward travel downwardly countercurrently over said upwardly moving layer to cause abrasive grinding of the material; and separating the particulate products of said abrasive grinding below a predetermined size from the remaining material above said predetermined size, and adding additional material to be ground at a rate about equal to the removal of ground material.

22. The method defined in claim 21, wherein said thickness of said layer is about 1–2 times the feed size of the material.

23. The method defined in claims 21 or 22, wherein the material is moved upwardly for a portion of its upward travel at a substantially constant angle.

24. The method defined in claim 21, further comprising:

(a) collecting the material that cascades downwardly to said collection zone; and (b) repeating the forming, the moving, the reversing and the separating of the material until the material is all reduced to below said predetermined size.

25. The method defined in claim 21, wherein said separating is performed by sluicing the particulate products from the remaining material with a flow of fluid.

26. An apparatus for autogenous grinding of materials, comprising:

(a) an endless conveyor;

(b) means at the lower end of said conveyor for feeding material to be ground to a feeding and collection zone of said conveyor;

(c) means for forming a layer of the material to be ground on said conveyor;

(d) an inclined section of said conveyor for carrying the material from the lower end thereof upward toward a top region thereof;

(e) means for reversing the direction of travel of the material, so that the material tumbles countercurrently over the upwardly moving layer of material and becomes abraded thereby; and (f) means for separating the abraded particles which are below a predetermined size from the remaining material particles which are above said predetermined size.

27. The apparatus defined in claim 26, wherein said separating means includes a multiplicity of small holes having a diameter about equal to said predetermined size in said conveyor belt, and a water spray nozzle connected to a source of water under pressure for spraying water on said conveyor belt to flush said abraded particles through said holes.

28. The apparatus defined in claim 26, wherein said reversing means includes a section of said conveyor belt inclined at a substantially steeper angle than said inclined section.

29. The apparatus defined in claim 26 wherein said conveyor includes a single conveyor belt having laterally extending lifters spaced along the length of said belt.

* * * * *